US005080623A

United States Patent [19]

Stein

[11] Patent Number: 5,080,623

[45] Date of Patent: Jan. 14, 1992

[54] FLYING BUBBLE TOY UTILIZING APERTURED STRIP

[76] Inventor: David Stein, 817 West End Ave., New York, N.Y. 10025

[21] Appl. No.: 472,195

[22] Filed: Jan. 30, 1990

[51] Int. Cl.[5] ..... A63H 33/28

[52] U.S. Cl. ..... 446/15; 446/46; 446/220

[58] Field of Search ..... 446/15, 46, 220; D21/61

[56] References Cited

U.S. PATENT DOCUMENTS 2,606,395 8/1952 Fulton ..... 446/15

3,745,693 7/1973 LaFata et al. ..... 446/15

4,157,632 6/1979 Everett ..... 446/46 X 4,654,017 3/1987 Stein ..... 446/15

*Primary Examiner*—Mickey Yu

*Attorney, Agent, or Firm*—Gottlieb, Rackman & Reisman

[57] ABSTRACT

A bubble toy which can be launched into free flight, producing a continuous stream of bubbles, is provided. The toy includes an extended flexible strip of material having bubble-forming apertures along its length which are able to store bubble solution, substantially retain the solution during launch and then release the solution as a stream of bubbles during flight.

30 Claims, 2 Drawing Sheets

FLYING BUBBLE TOY UTILIZING APERTURED STRIP

This invention relates to a bubble toy which can be launched into free flight, producing a continuous stream of bubbles. A preferred embodiment comprises an extended flexible strip of material having bubble-forming apertures along its length which are able to store bubble solution, substantially retain it during launch and then release said solution as a stream of bubbles during flight. Said apertured strip can be folded down and dipped into a relatively small container of bubble solution. Attached to on end of the strip can be a handle which can take several forms, for example: a rod or tube, which can be launched into free flight like a spear, trailing the bubble-forming strip behind; a ball; an aerodynamic body such as a toy airplane; or even a rotating flying-disk type toy such as the "frisbee". With the latter, swivel means such as a short length of ball chain attaching the end of the bubble-forming strip to the center of the flying disk allows the disk to spin in flight unencumbered by the bubble-forming strip trailing behind. The above embodiments and others to be described utilizing an apertured strip all produce a beautiful stream of bubbles during free flight.

DEFINITIONS

For purposes of this application, the following terms shall be defined as indicated.

"Bubble-forming aperture" refers to any opening in a material able to store bubble solution and release it in the form of bubbles.

"Apertured strip" refers to a strip of material comprising bubble-forming apertures.

A "flexible" strip is on made of flexible material, or one made of substantially rigid units flexibly connected, for example a chain.

"Aerodynamic means" is any means providing lift, either due to the motion of air over a surface, or due to buoyancy.

"Ladder-weave fabric" refers to a strip of fabric having a pattern resembling a ladder, that is with two extended sidepieces, joined at intervals by crossbars.

OBJECTS OF THE INVENTION

The objects of this invention are set forth as follows:

One object is to provide a toy able to produce bubbles during free flight.

Another object is to provide a toy able to produce bubbles continuously, during the longest possible flight.

A third object is to provide a toy which can be prepared for flight simply by dipping the bubble-forming apertures in solution, and which requires no accessories other than containers of solution.

A fourth object is to provide a toy which in some embodiments is easily caught, and which lends itself to games of catch involving two or more people. The toy should easily be caught even when the bubble-forming apertures are wet with slippery soap.

A fifth object is to provide a toy which except for the bubble-producing apertures, minimizes extraneous solution-bearing surfaces, so that a person attempting to catch the toy is not splashed with extraneous solution, and so that waste of solution is minimized.

A sixth object is to provide a toy which to the maximum extent possible, retains its bubble-forming solution during the sudden acceleration needed to launch the toy into flight.

A seventh object is to provide a toy which is safe. In particular the leading edges of the toy as it flies should be smooth, and not sharp or projecting, and should present no danger to the eyes of a catcher or passerby.

An eighth object is to provide a toy which in some embodiments may include an aerodynamic element for extending the length of flight, or causing the toy to boomerang back to the operator.

A ninth object is to provide a toy which comprises means for storing solution on board, and feeding said solution to the bubble-forming apertures during flight.

A tenth object is to provide a toy which produces mostly individual free-flying bubbles, rather than masses of foam, during flight.

An eleventh object is to provide a toy having a handle portion enabling dipping of the bubble-forming apertures in solution - without wetting the fingers.

A twelfth object is to provide a toy having a strip of bubble-forming apertures which may be folded or collapsed for dipping into a relatively small container of solution.

A thirteenth object is to provide a toy which is simple to manufacture, which can be marketed in a compact package, and which is simple to use, creating a minimum of mess.

GENERAL DESCRIPTION OF THE INVENTION

The toy of this invention comprises the following elements:

An extended flexible strip of material—such as a strip of ladder-weave cotton fabric—having a series of apertures along its length which are able to store substantial quantities of bubble solution and release said solution during flight in the form of bubbles.

Some embodiments of the toy apparatus further comprise handle means attached to said extended strip, said handle means able to be launched into flight, trailing said strip behind, creating a stream of bubbles, said handle means taking such forms as a rod, a ball, an aerodynamic element such as a toy plane, a flying disk, or other forms.

The method of this invention comprises the following steps:

Grasping the toy apparatus by the handle means,

Lowering the extended strip of bubble-forming apertures down into a container of solution, Raising said strip from said solution, and Launching the toy apparatus by said handle means into flight, whereby said extended strip of bubble-forming apertures produces a stream of bubbles during flight.

PRIOR ART

The advantages of the present invention will be clearly seen upon examination of the prior art relating to flying bubble toys.

U.S. Pat. No. 3,600,842 issued to Harold Bryman describes a toy consisting essentially of an open-ended cylindrical can with a bubble-forming ring placed across one of the ends. When the cylinder is dipped in solution and thrown forward through the air, bubbles are supposed to stream from the rear. The disadvantage of this device is that all the bubbles will be released at the start of the flight. By contrast, with the present toy most of the bubble solution stored in the apertured strip will be retained during launching, since during acceleration said strip will momentarily extend out roughly parallel to the direction of launch, and air will initially tend to flow past, rather than through the apertures. Later in the flight, the slowing speed and falling trajectory will cause air to begin flowing through the strip of apertures, producing a substantially continuous stream of bubbles during the middle and end portions of the flight.

U.S. Pat. No. 3,002,314 issued to I. Brottman, again is essentially a cylindrical can (in this case shaped like a rocket) with some bubble-forming apertures placed across one end. This patent has the same disadvantage—the bubbles tend to be released all at once due to the sudden acceleration of launching. In contrast, the present toy when launched retains substantial quantities of solution to release as bubbles later in the flight.

U.S. Pat. Nos. 3,745,693 issued to La Fata and Cuccio; U.S. Pat. No. 3,008,263 issued to J. Ellman; U.S. Pat. No. 2,942,375 issued to G. Bucic J.; and U.S. Pat. No. 2,398,513 issued to Bradley, all describe bubble toys designed to be whirled on a tether. All four incorporate a solution reservoir, means of feeding solution continuously to a bubble-forming aperture, and a tether, and are claimed to produce bubbles during tethered flight. However, none is designed to be dipped in solution, to produce bubbles continuously during free flight, or to be caught by a second player like the present invention.

U.S. Pat. No. 4,184,284 issued to Dino J. Rogahn describes a bubble toy meant to be launched through the air and intended to produce bubbles in flight. Rogahn's patent abstract states: "A plate-like member, having a plurality of apertures therethrough, carries a reservoir having a removable closure member with a lifting rotor. The device is propelled into rotating flight. During flight, the rotor lifts the closure member from the reservoir, freeing the solution which is distributed by centrifugal force as a film on the upper surface of the plate and over the apertures. Bubbles are produced in response to air passing through the apertures and the film of bubble-producing solution."

Instead of the "plate-like member" of Rogahn, the present invention has a flexible strip of bubble-forming apertures and its advantages are several. First, the free flow of air through and past either side of the apertured strip tends to carry the bubbles lightly away as individual free-flying spheres. By contrast the rotating Rogahn plate obstructs air flow so that bubbles tend to adhere to the plate, sliding against one another and dropping heavily in clumps of foam. Second, because the present toy is charged with solution by dipping, the bubble apertures can be much larger than Rogahn's tiny holes, whose size is strictly limited by the centrifugal feeding of solution across the plate. This means that in the present invention the bubbles produced are much larger, and of course more visible at a distance, which is important in a toy that will be thrown a considerable ways.

Several forms of handle means provided by the present invention allow a second player to easily catch the toy, this being another advantage over Rogahn's plate, which when slippery with soap would be nearly impossible to catch on the fly.

In the present toy, distinct separation of the immersible bubble-forming portion from the handle means minimizes the amount of extraneous solution carried during flight. By contrast the plate of Rogahn will still be carrying a load of extraneous soap at the end of the flight. An attempt to catch this soap-loaded plate will result in the receiving player being splashed with soap (a substantial hazard to the eyes), or most of the soap solution being simply dashed to the ground and wasted.

The present invention also has great advantages regarding ease of play as compared to Rogahn. With the Rogahn plate and propeller, between any two flights, the following procedure is required: retrieve the disk; retrieve the propeller; fit the propeller on the disk; pour soap from a bottle into the narrow opening on top; raise disk and propeller without spilling; wipe a portion of the disk sufficiently free of soap to grip; and throw. In contrast, the toy of the present invention is simply dipped in a container of solution and thrown. Furthermore, unlike the Rogahn plate, it can easily be caught by a second player (eliminating need of retrieval), who can then dip it in a second pan of solution, and throw it back. Play is simple and continuous, without constant interruptions for retrieval, fitting things together, filling reservoirs, etc.

My own U.S. Pat. No. 4,654,017 discloses a loop of flexible material that folds down into a small container of solution and is withdrawn for the purpose of making giant bubbles. This patent additionally cites several cases of prior art also directed towards making giant bubbles with a folding bubble loop. However none of these is directed towards a flying bubble toy or towards making a stream of small bubbles during flight.

My recent patent application entitled "Flying Bubble Toy" and filed Dec. 19, 1989 differs significantly from the present invention even though both are directed towards producing a stream of bubbles during flight. The earlier application discloses a planar open framework that is launched edgewise into rotating flight; the present invention has instead an extended, flexible, nonplanar apertured strip that is launched directly forward into nonrotating flight. Both the two constructions and launch methods achieve the aim of retaining solution during launch for later release during flight as a stream of bubbles.

FIGURES OF THE DRAWINGS

DETAILED DESCRIPTION OF THE DRAWINGS

Figure 1:
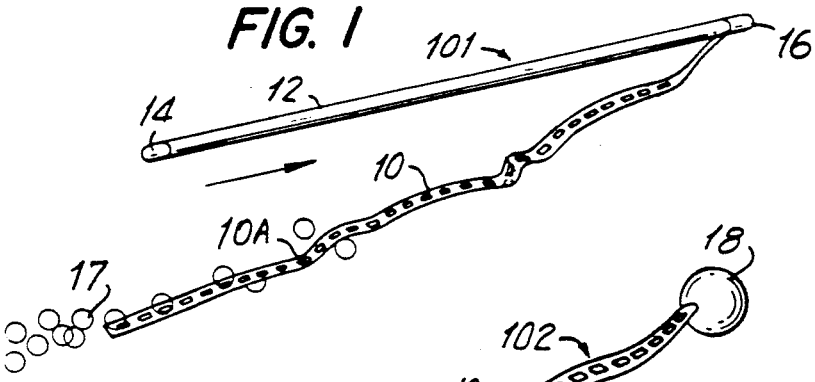
FIG. 1 shows a preferred embodiment of the toy having an extended strip of flexible ladder-weave cotton fabric, and a rod-shaped handle means attached at one end. When the toy is thrown through the air, a stream of bubbles flows out behind.

In FIG. 1, showing toy apparatus 101, the extended flexible strip 10 including a plurality of apertures 10A is shown as a ladder-weave fabric. Strip 10 could be of any material (cloth, plastic film, etc.) and pattern providing a series of bubble-forming apertures. A flexible strip comprised of substantially rigid links of plastic, metal, or other materials flexibly linked together is also possible, creating a series of bubble-forming apertures in a substantially flexible strip. Handle means 12, here shown as an elongated rod or tube has endcaps 14 and 16, one of which attaches an end of strip 10 to rod 12 by a friction fit. Many other sizes and shapes for the handle means and the connecting detail are possible. A stream of bubbles 17 issues from apertured strip 10.

Figure 2:
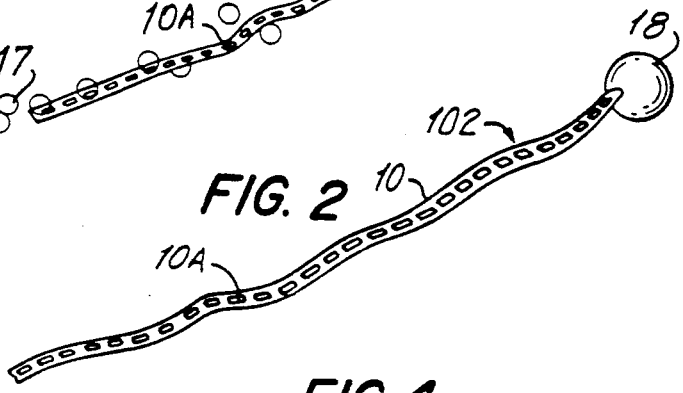
FIG. 2 shows another design showing the apertured strip and a ball acting as its handle means.

In FIG. 2, showing another embodiment of the apparatus 102, extended strip 10 including apertures 10A is attached to ball 18. Ball 18 may be of rubber, plastic, or any other material easy to throw and safe to catch. The connection may be made by means of a drilled hole, with the end of the strip being held in the hole by adhesive as shown, or any other suitable means.

Figure 3:
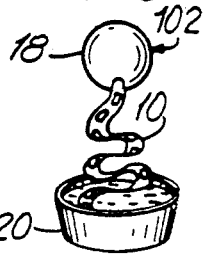
FIG. 3 shows the apparatus of FIG. 2, with the apertured strip being folded down into a small bowl of soap solution. Essentially the same method of dipping the strip of bubble-forming apertures would be employed with other types of apparatus, regardless of the form of the handle means.

In FIG. 3, apparatus 102 is shown being lowered (by a player) so that the extended strip 10 of bubble-forming apertures 10A is immersed into a small bowl of soap solution 20, thus filling said apertures with bubble solution.

Figure 4:
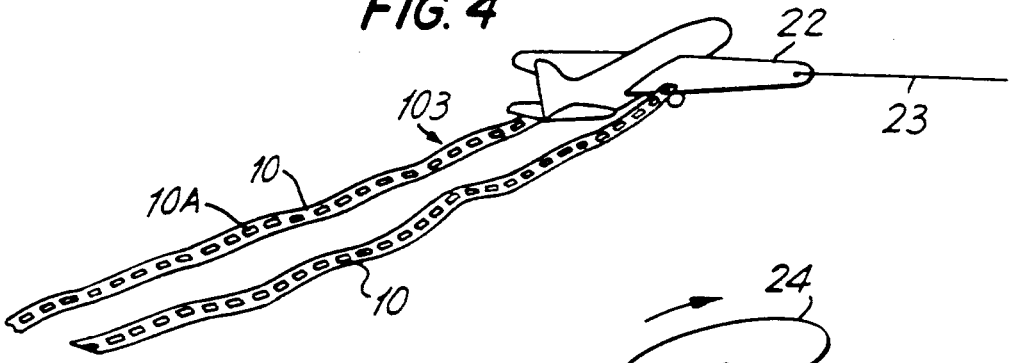
FIG. 4 shows two apertured strips with a model airplane as the handle means, the wings providing aerodynamic lift to increase the length of flight. An optional tether is also shown, which could enable the operator to whirl the apparatus in tethered flight, while producing a stream of bubbles.

In FIG. 4, another embodiment of the toy apparatus 103 shows two apertured strips 10 attached to model airplane 22. Optional tether 23 is attached to said airplane.

Figure 5:
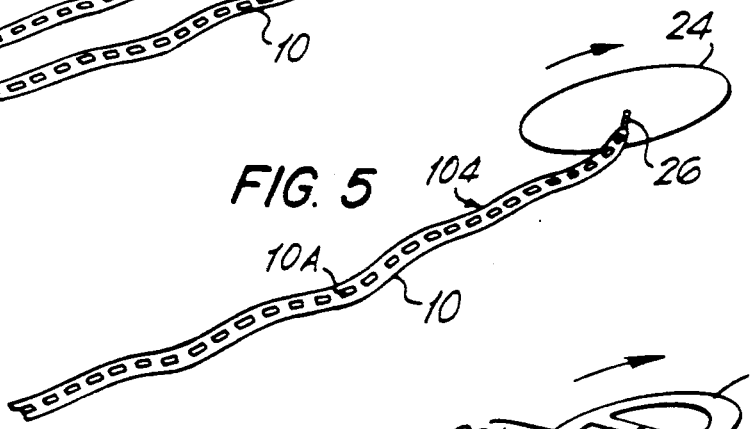
FIG. 5 shows the apertured strip attached to a disk-type flying toy.

In FIG. 5, embodiment of the apparatus 104 shows extended strip 10 connected to the center of a flying disk toy 24, such as a Frisbee® by a swivel means 26, here shown as a short length of ordinary ball chain, each segment of which swivels freely so that the rotating motion of disk 24 is not transmitted to strip 10. As shown, the ball chain ends can simply be pop-fit through punctures in disk 24 and strip 10, or be connected in any other manner allowing swivel action.

Figure 6:
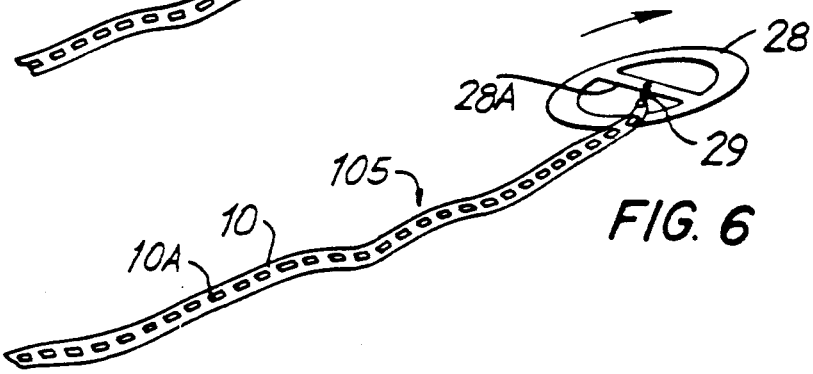
FIG. 6 shows the apertured strip attached to a flying ring toy.

In FIG. 6, embodiment of the apparatus 105 shows extended strip 10 connected to a flying ring toy 28 such as an Aerobie®, having an added center strut 28A, and a connecting swivel means 29 again shown as a ball chain.

Figure 7:
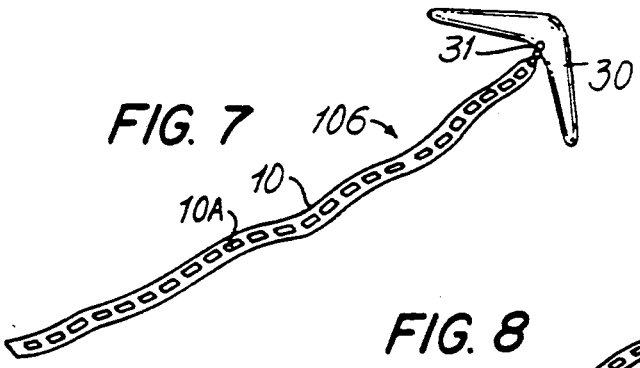
FIG. 7 shows the apertured strip attached to a boomerang.

In FIG. 7, this embodiment of the apparatus 106 shows extended strip 10 as connected to a boomerang 30, again by a swivel element 31, shown as a ball chain.

Figure 8:
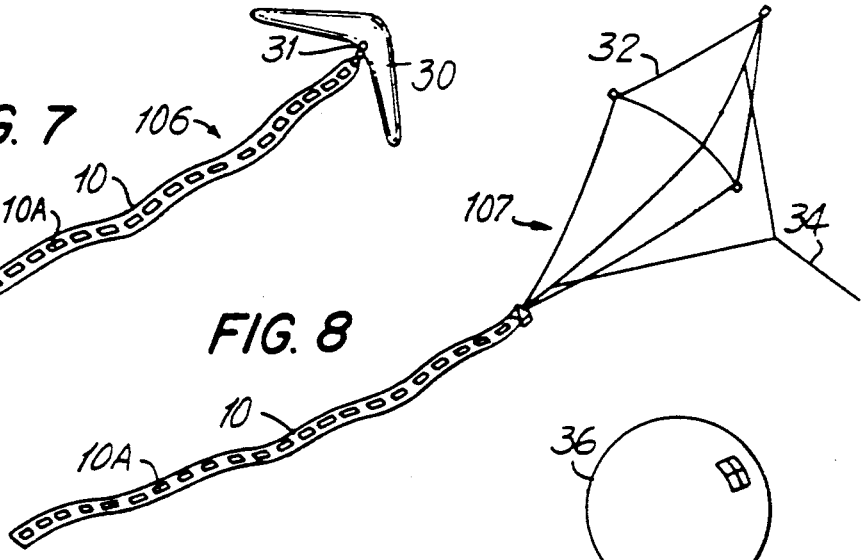
FIG. 8 shows the apertured strip attached as the tail of a kite.

In FIG. 8, showing another embodiment of apparatus 107, with extended strip 10 attached as the tail to kite 32 which is controlled by kitestring 34.

Figure 9:
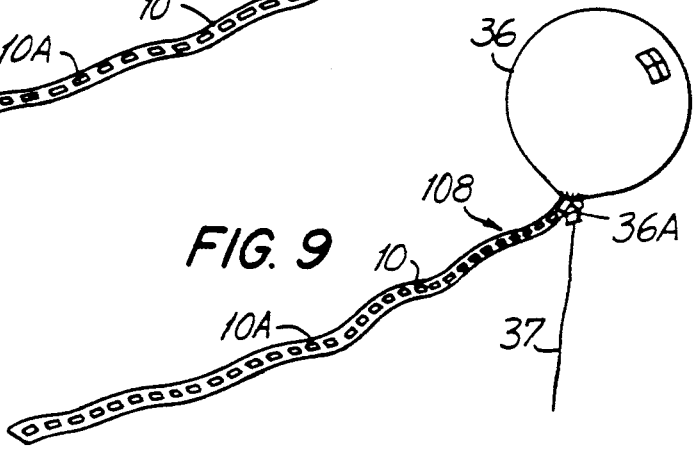
FIG. 9 shows the apertured strip attached to a balloon.

In FIG. 9, showing still another embodiment of apparatus 108, extended strip 10 is tied to the neck 36A of balloon 36, and the balloon may be held by optional string 37.

Figure 10:
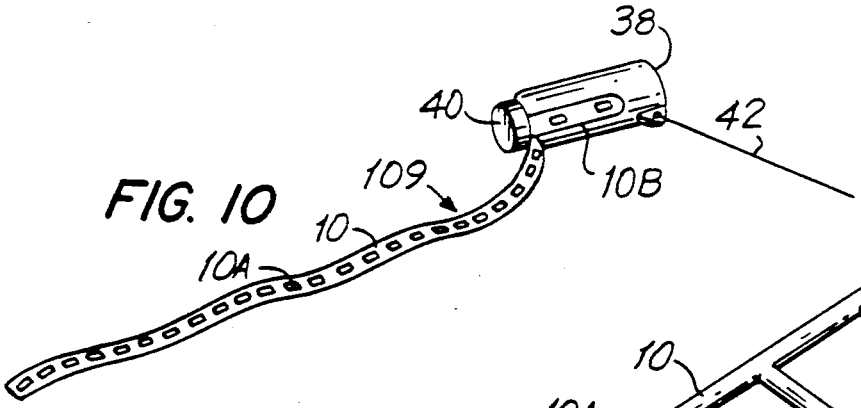
FIG. 10 shows the apertured strip attached to handle means comprising a reservoir for supplying soap solution to said strip. An optional tether is shown attaching to said handle means for enabling tethered flight.

In FIG. 10 showing still another embodiment of apparatus 109, extended strip 10 is attached to solution reservoir 38, having screwcap 40. An end extension 10B of strip 10 passes under the screwcap into the reservoir. Optional tether 42 also attaches to reservoir 38, enabling the apparatus to be swung round in tethered flight.

Figure 11:
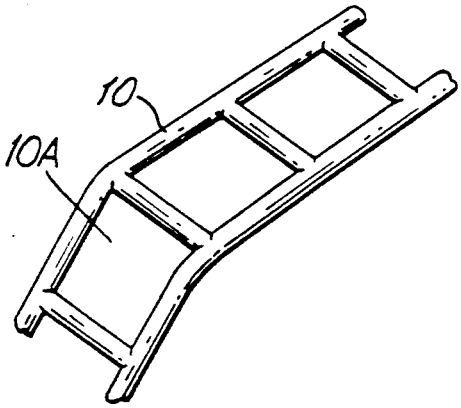
FIG. 11 shows a detail of the ladder-weave fabric shown in FIG. 1 and which is also usable in all the above embodiments.

In FIG. 11, showing a detail of a preferred ladder-weave cotton fabric 10, bubbles will emerge from apertures 10A.

OPERATION OF THE INVENTION

In FIG. 1, the operator grasps handle means 12, and lowers strip 10 including bubble-forming apertures 10A down into a container of solution in the manner illustrated in FIG. 3. Strip 10 is then withdrawn. Handle means 12 can then be thrown like a spear in the direction of the arrow. The acceleration of launch will cause extended strip 10 to stretch out momentarily parallel to the launch, so that air flows past rather than through apertures 10A, temporarily retaining substantial amounts of solution in said apertures. Later as the slowing and falling trajectory causes air to pass through apertures 10A, bubbles will be produced in a continuous stream. A second player may then catch handle means 12, and repeat the dipping and throwing process described.

Note that in this and some other embodiments, the handle means acts as a weight providing the inertial mass necessary to keep the apertured strip moving forward in flight, rather than tumbling, tangling, and quickly falling, as would happen were the inertial mass lacking.

Instead of throwing form 101 of the apparatus, the operator may choose to simply wave handle means 12 around as a wand, causing strip 10, to describe loops and spirals, while trailing behind a stream of bubbles.

In FIGS. 2 and 3, apparatus 102 can be dipped, thrown, caught, or simply waved around in a similar manner, with similar beautiful effects.

In FIG. 4, the dipping and throwing process is as already described, and the aerodynamic lift of model airplane 22 extends the flight. Optional tether 23 can be used by the operator to control the speed and orientation of the airplane during tethered flight, thereby controlling the stream of bubbles issuing behind.

In FIG. 5, after apertured strip 10 has been dipped in solution, the disk-type flying toy 24 is gripped and thrown like an ordinary Frisbee®. Swivel means 26 allows strip 10 to trail gracefully straight out behind rotating disk 24, leaving a trail of bubbles in its path.

The operation in FIGS. 6 and 7 of the flying ring 28 and boomerang 30 is exactly similar.

In FIG. 8, using kite 32 as a handle, extended strip 10 is first dipped in solution, following which the kite is launched. Optionally, to increase continuity of bubble production, a solution reservoir 38, like that shown in FIG. 10 could be added where strip 10 attaches to the bottom of the kite.

In FIG. 9, using a balloon 36 as a handle, extended strip !0 is dipped in solution, and the balloon then is launched. Or the balloon might be restrained, using either strip 10 itself or optional tether 37 as a balloon string.

In FIG. 10, solution contained in reservoir 38 is absorbed by extended strip portion 10B inside the reservoir, and is conducted through the tight space between screwcap 40 and reservoir 38 by capillary action, replenishing the supply of solution in strip 10 as it is released in bubbles from apertures 10A. Optional tether 42 ca be used by the operator to apply increasing acceleration and centrifugal force also tending to force solution from reservoir 38 between the cap 40 and reservoir 38, and into strip 10.

In FIG. 11, solution stored in the absorptive cotton members of apertured strip 10 is formed into bubbles by passage of air through apertures 10A.

There have now been disclosed several different forms of a toy apparatus comprising a extended flexible strip having bubble-forming apertures along its length able to store and release substantial quantities of solution in the form of bubbles during flight. Several types of handle means have been shown, enabling the strip to be dipped in solution, launched into flight, and caught by a second player who can repeat the dipping and throwing process. Several of the handle means incorporate aerodynamic elements able to extend the flight, or boomerang the toy back to the person launching it. Also, several examples show the use of optional tethers, as well as a solution reservoir which may be added to the apparatus to increase continuity of bubble production.

There has also been disclosed a method of play including grasping the apparatus by handle means; dipping the extended strip of bubble-forming apertures into solution; launching the apparatus into the air whereby said strip extends out momentarily parallel to the direction of launch, causing air to flow past rather than through said apertures, thus retaining substantial amounts of solution; and finally, allowing the slowing and falling trajectory of flight to begin passing air through said apertures, thereby producing a continuous stream of bubbles later in the flight.

I claim:

1. A bubble toy comprising an extended flexible strip of material having a first end attached to a handle means and a second free end, said material including a plurality of apertures able when dipped in bubble solution to store substantial quantities of said solution and release it in the form of bubbles.

2. The toy of claim 1, wherein said flexible material is a fabric, with bubble-forming apertures formed therein.

3. The toy of claim 1, wherein said material is comprised of substantially rigid units, flexibly linked together.

4. The toy of claim 1, further including a weight attached to said strip, said weight providing the inertial mass which keeps said strip moving forward during flight.

5. The toy of claim 1, wherein said handle means enables the toy to be launched into the air.

6. The toy of claim 5, wherein said handle means further enables the toy to be caught by a second player.

7. The toy of claim 1 wherein said handle means is an elongated rod.

8. The toy of claim 7 wherein said rod enables the toy to be launched like a spear.

9. The toy of claim 1, wherein said handle means is a ball.

10. The toy of claim 5, wherein said handle means comprises an aerodynamic element for enabling the flight of said toy to be lengthened.

11. The toy of claim 10, wherein the aerodynamic element is in the form of an airplane.

12. The toy of claim 1 wherein said handle is a kite.

13. The toy of claim 10, wherein the aerodynamic element is a flying disk.

14. The toy of claim 10, wherein the aerodynamic element is a flying ring.

15. The toy of claim 10, wherein the aerodynamic element is a boomerang.

16. The toy of claim 10, further including a swivel means connecting the extended strip of apertures to the aerodynamic element so that said extended strip is prevented from rotating.

17. The toy of claim 1 wherein said handle means is a balloon.

18. The toy of claim 1, further including a reservoir, feeding solution to the bubble forming apertures.

19. The toy of claim 2 wherein said flexible strip comprises ladder-weave fabric.

20. The toy of claim 2, wherein said fabric is made of plastic.

21. A method of producing a continuous stream of bubbles from a bubble toy comprising an extended flexible strip of material including a plurality of apertures able to hold and release bubble solution in the form of bubbles and handle means attached to said material, said method including the following steps:

grasping the handle means, dipping the extended flexible strip into bubble solution, launching said toy into the air whereby the acceleration of launching causes said strip to momentarily extend out substantially parallel to the direction of launch, further causing air to initially flow substantially past rather than through said apertures, thereby temporarily retaining solution contained in said apertures, and allowing the slowing and falling trajectory of the toy's flight to begin passing air through the apertures, thereby producing a stream of bubbles during flight.

22. The method of claim 21, further including the step of catching the toy by the handle means.

23. The method of claim 22, wherein said catching step comprises a second player catching the toy.

24. A method of producing a continuous stream of bubbles from a bubble toy comprising an extended flexible strip of material including a plurality of apertures able to hold and release bubble solution in the form of bubbles, said method including the following steps:

dipping the extended flexible strip into the bubble solution, launching said toy into the air whereby the acceleration of launching causes said strip to momentarily extend out substantially parallel to the direction of launch, for further causing air to initially flow substantially past rather than through said apertures, thereby temporarily retaining solution contained in said apertures, and allowing the slowing and falling trajectory of the toy's flight to begin passing air through the apertures, thereby producing a stream of bubbles during flight.

25. The method of claim 24, further including the step of catching the toy.

26. A bubble toy comprising an extended flexible strip of material, said material including a plurality of apertures able when dipped in bubble solution to store substantial quantities of said solution and release it in the form of bubbles, said toy further comprising a handle means attached to said strip of material, said handle means enabling dipping of said strip without wetting the operator's hands, said handle means being selected from the group consisting of a ball, an airplane, a flying disk, a flying ring, a boomerang, a balloon, and a kite.

27. A bubble toy comprising an extended flexible strip of material made of fabric which is attached to an element capable of providing aerodynamic lift, said fabric material including and formed with a plurality of bubble forming apertures and able to store substantial quantities of said solution and release it in the form of bubbles, said toy adapted for launching into the air, said element enabling the flight of said toy to be lengthened.

28. The bubble toy of claim 27, wherein said aerodynamic element is selected from the group comprising a toy airplane, a flying disk, a flying ring and a boomerang.

29. The bubble toy of claim 27, wherein said aerodynamic element is suitable as a handle means for enabling the toy to be both launched into the air and to be caught by a second player.

30. The bubble toy of claim 27, further including a weight attached to said flexible strip for providing the inertial mass which keeps the strip moving forward during flight.

* * * * *